US008535098B2

(12) United States Patent
Chen et al.

(10) Patent No.: US 8,535,098 B2
(45) Date of Patent: Sep. 17, 2013

(54) ELECTRONIC DEVICES CONNECTOR

(75) Inventors: Yun-Lung Chen, New Taipei (TW); Quan-Guang Du, Wuhan (CN); Gang Su, Wuhan (CN)

(73) Assignees: Hong Fu Jin Precision Industry (WuHan) Co., Ltd., Wuhan (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/400,190

(22) Filed: Feb. 20, 2012

(65) Prior Publication Data

US 2012/0302099 A1 Nov. 29, 2012

(30) Foreign Application Priority Data

May 27, 2011 (CN) ..... 2011 1 0140004

(51) Int. Cl.
*H01R 13/648* (2006.01)

(52) U.S. Cl.
USPC ..... 439/607.35

(58) Field of Classification Search
USPC ..... 439/607.35, 607.55, 607.54, 607.25, 439/660, 76.1
See application file for complete search history.

(56) References Cited

U.S. PATENT DOCUMENTS

| | | | | |
|---|---|---|---|---|
| 7,686,656 | B2 * | 3/2010 | Zheng et al. | 439/660 |
| 7,753,724 | B2 * | 7/2010 | Gong et al. | 439/541.5 |
| 7,789,706 | B2 * | 9/2010 | Chen et al. | 439/607.35 |
| 7,841,905 | B2 * | 11/2010 | Zheng et al. | 439/660 |
| 7,862,346 | B1 * | 1/2011 | Wan et al. | 439/79 |
| 7,862,378 | B1 * | 1/2011 | Wan et al. | 439/607.35 |
| 7,874,868 | B2 * | 1/2011 | Chang | 439/540.1 |
| 7,922,533 | B2 * | 4/2011 | Wang et al. | 439/607.23 |

* cited by examiner

*Primary Examiner* — Alexander Gilman
(74) *Attorney, Agent, or Firm* — Altis Law Group, Inc.

(57) ABSTRACT

A connector includes an enclosure and a body. The enclosure includes a top plate and a side plate perpendicularly connected to the top plate. The side plate has a second side edge substantially perpendicular to the top plate. The body is received in the enclosure and includes a sidewall. The sidewall abuts the side plate and is substantially parallel to the side plate. The sidewall includes a first part and a second part, and the second part defines a first mounting hole. The top plate abuts the body. A mounting piece extends from the top plate; the first part of the sidewall is in a first side of the side edge and covered by the side plate. The second part of the sidewall is in a second side opposite to the first side and exposed out of the side plate. The mounting piece is engaged in the first mounting hole.

19 Claims, 3 Drawing Sheets

ELECTRONIC DEVICES CONNECTOR

BACKGROUND

1. Technical Field

The present disclosure relates to connectors, and particularly to a connector used in an electronic device.

2. Description of Related Art

Many electronic devices, such as computers, need a plurality of connectors. The connectors may be, for example, USB connectors, or A-jack connectors. The connector may include a body and a metallic enclosure. The metallic enclosure entirely surrounds the body and may include a front plate and a rear plate secured to the front plate. The rear plate may be connected to a ground wire of the body, the front plate may be connected to a ground wire of a circuit board of the electronic device, and the connector may be connected to the ground. However, the metallic enclosure may be easily disengaged from the body. Therefore, an improved connector for electronic devices may be desired.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
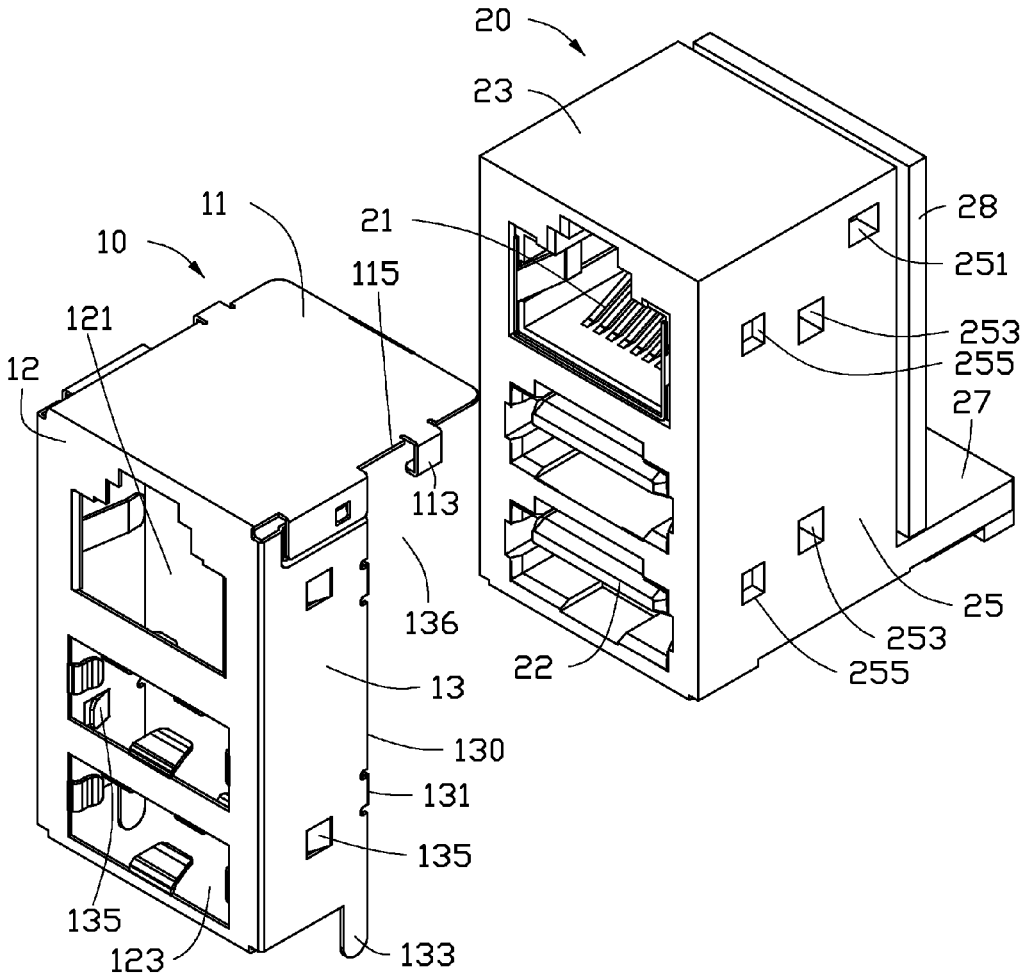
FIG. 1 is an exploded, isometric view of an embodiment of a connector.
Figure 2:
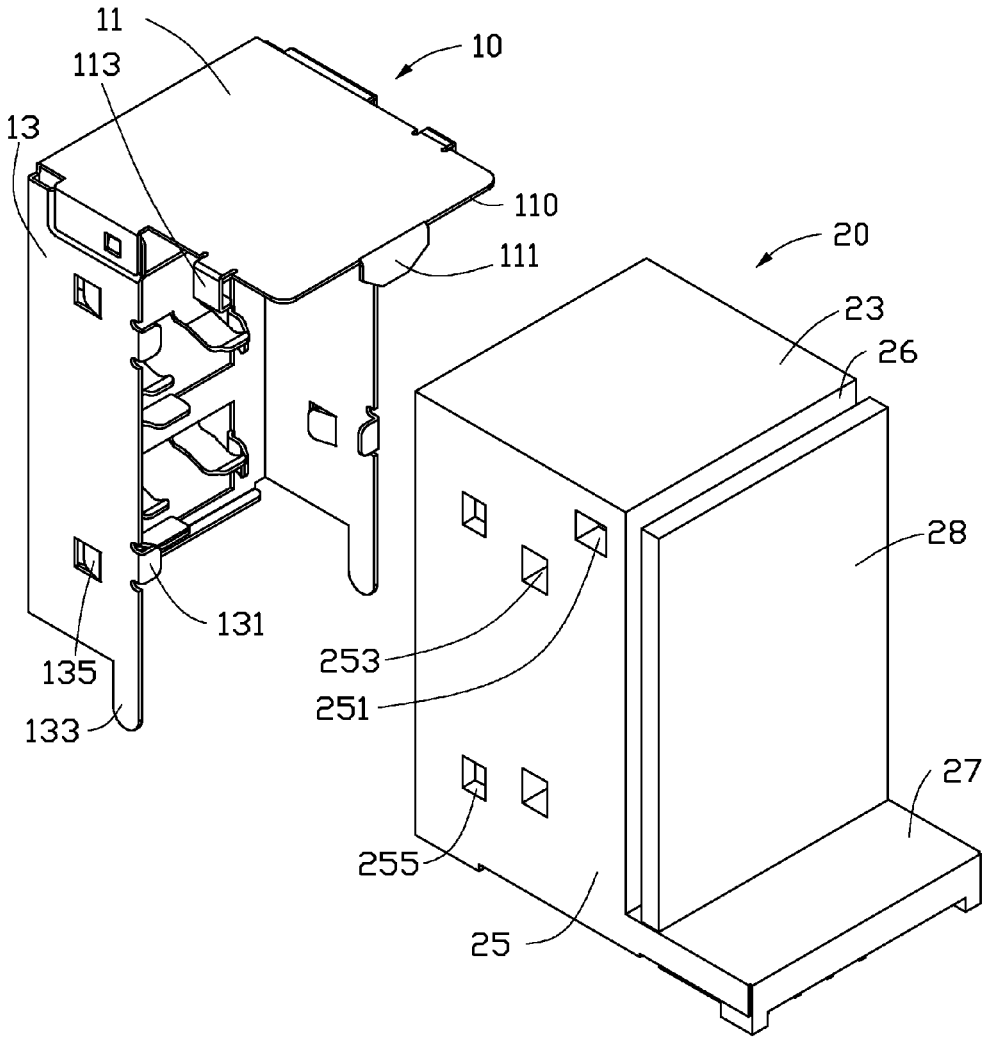
FIG. 2 is similar to FIG. 1, but viewed in a different aspect.

Referring to FIGS. 1 and 2, a connector in accordance with an embodiment includes an enclosure 10 and a body 20.

The enclosure 10 includes a top plate 11, a front plate 12, and two side plates 13. The two side plates 13 are opposite to each other. In one embodiment, the top plate 11 is substantially perpendicular to the front plate 12 and the two side plates 13, and the front plate 12 is substantially perpendicular to the two side plates 13. The top plate 11 includes a first side edge 110. The first side edge 110 is substantially parallel to the front plate 12. A flange 111 extends perpendicularly from the first side edge 110 and is substantially parallel to the front plate 12. Each of the two side plates 13 includes a second side edge 130. The second side edge 130 is substantially parallel to the front plate 12 and perpendicular to the first side edge 110. A distance between the first side edge 110 and the front plate 12 is greater than between the second side edge 130 and the front plate 12. A third side edge 115 is connected to the first side edge 110 and the second side edge 130. The third side edge 115 is substantially perpendicular to the first side edge 110 and the second side edge 130. A first mounting piece 113 extends from the third side edge 115, and the first mounting piece 113 is substantially "L" shaped. Two second mounting pieces 131 extend from the second side edge 130 and are substantially "L" shaped. An inserting piece 133 extends from a bottom edge of each of the two side plates 13. Two resilient pieces 135 extend from each of the two side plates 13 towards each other. An opening 136 is defined between the second side edge 130 and the third side edge 115. The first mounting piece 113 and each of the two second mounting pieces 131 extend into the opening 136. The front plate 12 defines a first opening 121 and two second openings 123. In one embodiment, a network cable is run through the first opening 121, and USB cables are respectively run through the two second openings 123.

The body 20 includes a top wall 23, two sidewalls 25, a rear wall 26, a base 27, and a first circuit board 28. The two sidewalls 25, the rear wall 26, and the first circuit board 28 are located on the base 27. In one embodiment, the top wall 23 is substantially parallel to the base 27, the two sidewalls 25 and the rear wall 26 are substantially perpendicular to the base 27, and the first circuit board 28 is substantially parallel to the rear wall 26. The first circuit board 28 is located in a corner between the base 27 and the rear wall 26. Each of the two sidewalls 25 defines a first mounting hole 251, two second mounting holes 253 and two positioning holes 255. The first mounting hole 251 corresponds to the first mounting piece 113. The two second mounting holes 253 correspond to the two second mounting pieces 131. The two positioning holes 255 correspond to the two resilient pieces 135. The body 20 defines a first connecting portion 21 and two second connecting portions 22. In one embodiment, the first connecting portion 21 is configured for connecting to the network cable, and the two second connecting portions 22 are configured for connecting to the two USB cables.

Figure 3:
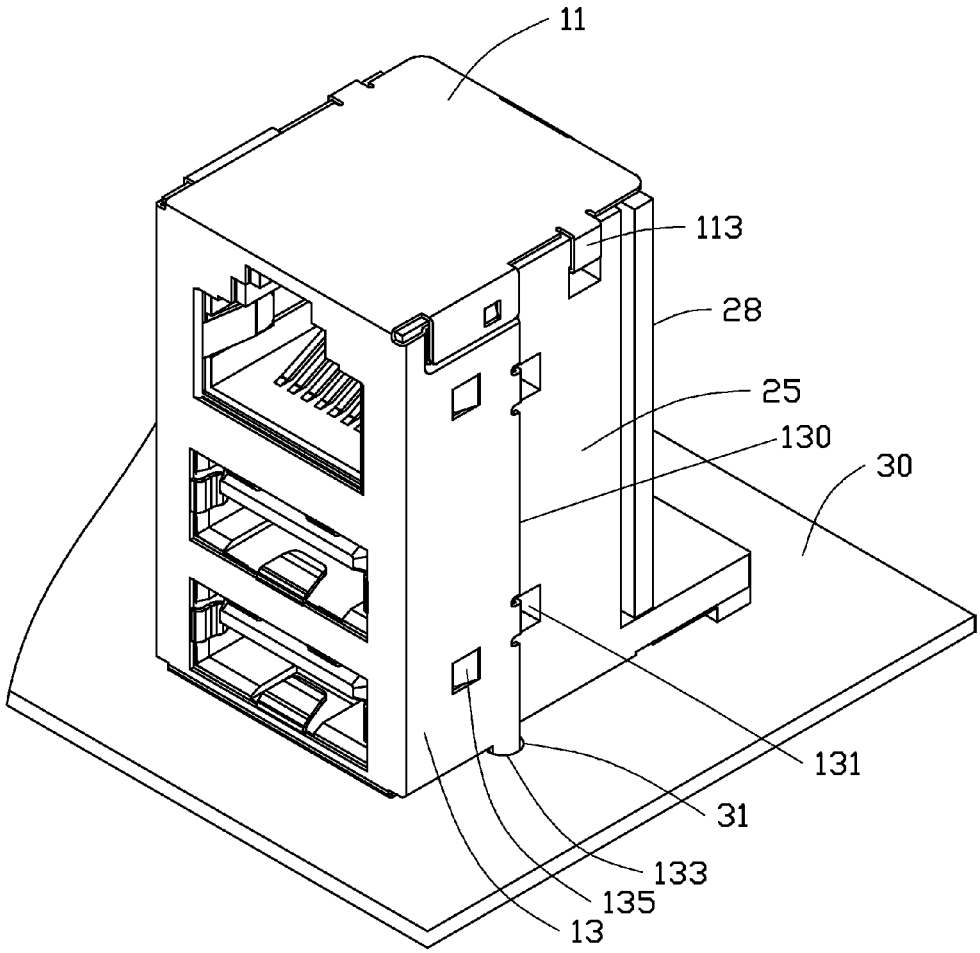
FIG. 3 is an assembled, isometric view of the connector of FIG. 1 and a circuit board.

Referring to FIG. 3, in assembly, the enclosure 10 is moved to the body 20. The first mounting piece 113 and each of the two second mounting pieces 131 are elastically deformed. The enclosure 10 can be further moved on the body 20. The two resilient pieces 135 are elastically deformed when pressed by the body 20. When the first mounting piece 113 is aligned to the first mounting hole 251, and each of the two second mounting pieces 131 is aligned to each of the two second mounting holes 253, the resilient pieces 135 rebound to engage in the two positioning holes 255, the first mounting piece 113 rebounds to engage in the first mounting hole 251, and each of the two second mounting pieces 131 rebounds to engage in each of the two second mounting holes 253. Thus, the enclosure 10 is secured to the body 20. The top plate 11 abuts the top wall 23, and each of the two side plates 13 abuts each of the two sidewalls 25. The flange 111 is electronically connected to a ground wire of the first circuit board 28 by soldering.

The connector is connected to a second circuit board 30. The second circuit board 30 defines two connecting holes 31. The inserting piece 133 is inserted into each of the two connecting holes 31 and electronically connected to a ground wire of the second circuit board 30 by soldering.

It is to be understood, however, that even though numerous characteristics and advantages of the embodiments have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector, comprising:

an enclosure comprising a top plate and a side plate perpendicularly connected to the top plate, and the side plate comprising a second side edge substantially perpendicular to the top plate;

a body received in the enclosure and comprising a base and a sidewall located on the base, the sidewall abutting the side plate and being substantially parallel to the side plate, and the sidewall comprising a first part and a second part; and the second part defining a first mounting hole; and a first circuit board secured to the base;

wherein the top plate abuts the body, and a mounting piece and a flange extend from two adjacent edges of the top plate; the first part of the sidewall is located in a first side of the second side edge and covered by the side plate, and the second part of the sidewall is located in a second side of the second side edge opposite to the first side and exposed out of the side plate; the mounting piece is engaged in the first mounting hole; and the flange is electronically connected to a ground wire of the first circuit board.

2. The connector of claim 1, wherein the top plate comprises a first side edge and a third side edge substantially perpendicularly connected to the second side edge; the mounting piece extends from the third side edge, an opening is defined between the third side edge and the second side edge, and the mounting piece extends in the opening.

3. The connector of claim 2, wherein the enclosure further comprises a front plate substantially perpendicular to the top plate and the side plate, and the front plate abuts the body; the first side edge and the second side edge are substantially parallel to the front plate, the first side edge is substantially perpendicular to the second side edge, and a distance between the first side edge and the front plate is larger than a distance between the second side edge and the front plate.

4. The connector of claim 2, wherein the flange extends from the first side edge, the body further comprises a rear wall substantially perpendicular to the sidewall, and the first circuit board is secured beside the rear wall.

5. The connector of claim 4, wherein the body further comprises a connecting portion electronically connected to the first circuit board, and the connecting portion is adapted to connect a network cable or a USB cable.

6. The connector of claim 2, wherein the side plate further comprises a second mounting piece, and the second mounting piece extends from the second side edge and extends into the opening.

7. The connector of claim 6, wherein the second part of the sidewall further defines a second mounting hole, and the second mounting piece is engaged in the second mounting hole.

8. The connector of claim 1, wherein the side plate further comprises an inserting piece, and the inserting piece is adapted to be inserted into a second circuit board and electronically connected to a ground wire of the second circuit board.

9. The connector of claim 1, wherein a resilient piece extends from the side plate, the first part of the sidewall defines a positioning hole, and the resilient piece is engaged in the positioning hole.

10. A connector, comprising:

an enclosure comprising a top plate and a side plate perpendicularly connected to the top plate, the top plate comprising a first side edge and a third side edge, and the side plate comprising a second side edge substantially perpendicular to the third side edge;

a body received in the enclosure and comprising a sidewall and rear wall substantially perpendicular to the sidewall, the sidewall abutting the side plate and being substantially parallel to the side plate, and the sidewall comprising a first part and a second part; and the second part defining a first mounting hole; and a first circuit board located beside the rear wall;

wherein the top plate abuts the body, and a mounting piece extends from the third side edge; the first part of the sidewall is located in a first side of the second side edge and covered by the side plate, and the second part of the sidewall is located in a second side of the second side edge opposite to the first side and exposed out of the side plate; and the mounting piece is engaged in the first mounting hole; the top wall is electronically connected to a first ground wire of the first circuit board, and the sidewall is adapted to be electronically connected to a second ground wire of a second circuit board.

11. The connector of claim 10, wherein an opening is defined by the third side edge and the seconds side edge, and the mounting piece extends in the opening.

12. The connector of claim 11, wherein the side plate further comprises a second mounting piece, the second mounting piece extends from the side edge and extends into the opening.

13. The connector of claim 12, wherein the second part of the sidewall further defines a second mounting hole, and the second mounting piece is engaged in the second mounting hole.

14. The connector of claim 10, wherein the enclosure further comprises a front plate substantially perpendicular to the top plate and the side plate, and the front plate abuts the body; the first side edge and the second side edge are substantially parallel to the front plate, the first side edge is substantially perpendicular to the second side edge, and a distance between the first side edge and the front plate is larger than a distance between the second side edge and the front plate.

15. The connector of claim 10, wherein a flange extends from the first side edge, the body further comprises a rear wall substantially perpendicular to the sidewall, and the flange is electronically connected to the first ground wire of the first circuit board.

16. The connector of claim 10, wherein the body further comprises a connecting portion electronically connected to the first circuit board, and the connecting portion is adapted to connect a network cable or a USB cable.

17. The connector of claim 10, wherein the side plate further comprises an inserting piece, and the inserting piece is adapted to be inserted into the second circuit board and electronically connected to the second ground wire of the second circuit board.

18. The connector of claim 10, wherein a resilient piece extends from the side plate, the first part of the sidewall defines a positioning hole, and the resilient piece is engaged in the positioning hole.

19. A connector, comprising:

an enclosure comprising a top plate and a side plate perpendicularly connected to the top plate, and the side plate comprising a second side edge substantially perpendicular to the top plate; and a body received in the enclosure and comprising a sidewall, the sidewall abutting the side plate and being substantially parallel to the side plate, and the sidewall comprising a first part and a second part; and the second part defining a first mounting hole;

wherein the top plate abuts the body, and a mounting piece extends from the top plate; the first part of the sidewall is located in a first side of the side edge and covered by the side plate, and the second part of the sidewall is located in a second side of the side edge opposite to the first side and exposed out of the side plate; and the mounting piece is engaged in the first mounting hole; a resilient piece extends from the side plate, the first part of the sidewall defines a positioning hole, and the resilient piece is engaged in the positioning hole.

* * * * *